US006485580B1

(12) United States Patent
Nakada et al.

(10) Patent No.: US 6,485,580 B1
(45) Date of Patent: Nov. 26, 2002

(54) COMPOSITION AND PROCESS FOR TREATING SURFACES OR LIGHT METALS AND THEIR ALLOYS

(75) Inventors: Kazuya Nakada, Utsunomiya; Motoki Kawaguchi, Kawachi-gun; Kazuhiro Maeda, Kumagaya, all of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/700,733

(22) PCT Filed: May 20, 1999

(86) PCT No.: PCT/US99/10450

§ 371 (c)(1),
(2), (4) Date: Nov. 20, 2000

(87) PCT Pub. No.: WO99/60186

PCT Pub. Date: Nov. 25, 1999

(30) Foreign Application Priority Data

May 20, 1998 (JP) ..... 10-137886

(51) Int. Cl.[7] ..... C23C 22/48; C23C 22/56; C23C 22/57

(52) U.S. Cl. ..... 148/247; 106/14.12; 106/14.21; 148/275

(58) Field of Search ..... 106/14.12, 14.21; 148/247, 275

(56) References Cited

U.S. PATENT DOCUMENTS

| | | | | |
|---|---|---|---|---|
| 2,438,877 A | | 3/1948 | Spruance, Jr. | 148/6.16 |
| 4,148,670 A | | 4/1979 | Kelly | 148/6.15 R |
| 4,326,894 A | * | 4/1982 | Konnert | 118/316 |
| 4,595,424 A | * | 6/1986 | Hacias | 148/241 |
| 4,600,447 A | * | 7/1986 | Opitz et al. | 148/247 |
| 4,610,732 A | * | 9/1986 | Sasaki et al. | 148/273 |
| 5,112,513 A | | 5/1992 | Bressel et al. | 252/79.1 |
| 5,427,632 A | * | 6/1995 | Dolan | 106/14.12 |
| 6,083,309 A | | 4/2000 | Tominson | 106/14.21 |
| 6,193,815 B1 | | 2/2001 | Wada et al. | 148/247 |
| 6,200,639 B1 | | 3/2001 | Nakada et al. | 428/651 |

FOREIGN PATENT DOCUMENTS

| | | |
|---|---|---|
| WO | WO 9702369 | 1/1997 |
| WO | WO 9852699 | 11/1998 |
| WO | WO 9937829 | 7/1999 |

OTHER PUBLICATIONS

JP 52–131937 –Nov. 5, 1977 (corresp. to US 4,148,670) (Abstract only).
JP 57–041376 –Questel Orbit Accession No. 1982–30092E [15] –Derwent Manual code: CPI:M14–D; Derwent Class M14 (Abstract only) (Mar. 8, 1982).
JP 08–144063 –Questel Orbit Accession No. 1996–319363 [32]; Sec. Acc. No. CPI: C1996–101841—Derwent Manual code: CPI: 14D01; Derwent (Abstract only) (Jun. 4, 1996).
JP 91–006994—Jan. 31, 1991 (9109) (Abstract only).

* cited by examiner

*Primary Examiner*—Anthony J. Green
(74) *Attorney, Agent, or Firm*—Stephen D. Harper

(57) ABSTRACT

An aqueous bath for treating the surfaces of light metals and light metal alloys that does not contain hexavalent chromium or produce any other highly polluting effluent and that forms a highly corrosion-resistant and highly paint-adherent conversion coating has a pH from 1.0 to 7.0 and contains from 0.01 to 50 g/L of permanganic acid and/or salt(s) thereof and 0.01 to 20 g/L of at least one water soluble compound of titanium or zirconium.

18 Claims, No Drawings

COMPOSITION AND PROCESS FOR TREATING SURFACES OR LIGHT METALS AND THEIR ALLOYS

FIELD AND BACKGROUND OF THE INVENTION

The invention relates to a novel water-based liquid composition, often called a "bath" hereinafter for brevity, even though it may be used with other methods than immersion for establishing contact between the composition and the surface to be treated with it, and to processes using such compositions for treating the surfaces of light metals and light metal alloys for the purpose of imparting thereto an excellent corrosion resistance and an excellent adherence to paint films. This invention can be applied in a particularly advantageous manner to the surface treatment of aluminum fin stock for heat exchangers, aluminum alloy coil, aluminum alloy sheet, and magnesium and magnesium alloy automotive and aerospace components and electronic devices and instruments.

The baths used to treat aluminum and aluminum alloy surfaces can be broadly classified into chromate-type baths and non-chromate-type baths. Chromic acid chromate conversion baths and phosphoric acid chromate conversion baths are typical examples of the chromate-type treatment baths.

Chromic acid chromate conversion baths first reached practical application in about 1950 and even now are widely used for the surface treatment of aluminum (the word "aluminum" and all of its grammatical variations being understood hereinafter, unless the context indicates otherwise, to apply to alloys that contain at least, with increasing preference in the order given, 45, 60, 75, 85, 90, 95, or 99% by weight of aluminum) fin stock for heat exchangers and aluminum wheels, building materials, and aerospace materials. The main components in chromic acid chromate conversion baths are chromic acid and a fluoride-type reaction accelerator. This type of bath produces a conversion coating containing moderate amounts of hexavalent chromium on the metal surface.

Phosphoric acid chromate conversion baths originated with the invention disclosed in U.S. Pat. No. 2,438,877. The main components in phosphoric acid chromate conversion baths are chromic acid, phosphoric acid, and hydrofluoric acid. A conversion coating whose main component is hydrated chromium phosphate is formed by this type of bath on the metal surface. Since the resulting conversion coating does not contain hexavalent chromium, this type of bath is in wide used at the present time as an underpaint treatment for the body stock and lid stock of beverage cans.

While the conversion coatings generated by these chromate-type surface treatment baths exhibit an excellent corrosion resistance and an excellent adherence to paint films, these treatment baths also contain toxic hexavalent chromium. The associated environmental problems have made it desirable to use treatment baths that are completely free of hexavalent chromium.

The method disclosed in Japanese Patent Publication (Kokai or Unexamined) Number Sho 52-131937 (131,937/1977) exemplifies chromium-free surface treatment baths.

Surface treatment baths of this type are acidic (pH= approximately 1.5 to 4.0) aqueous coating solutions that contain phosphate, fluoride, and zirconium or titanium or a mixture thereof. The treatment of metal surfaces with such a treatment bath results in the formation on the metal surface of a conversion coating whose main component is an oxide of zirconium or titanium. Non-chromate-type surface treatment baths offer the advantage of not containing hexavalent chromium and for this reason are widely used at present for treating aluminum D1 can surfaces. Unfortunately, the coatings produced by non-chromate-type surface treatment baths are less corrosion resistant than chromate coatings.

The treatment method disclosed in Japanese Laid Open (Kokai or Unexamined) Patent Application Number Sho 57-41376 (41,376/1982) involves treating the surface of aluminum, magnesium, or an alloy thereof with an aqueous solution containing at least one selection from titanium salts and zirconium salts and at least one selection from imidazole derivatives.

The coatings produced in the working examples of Japanese Laid Open Patent Application Number Sho 57-41376 have an anticorrosion performance corresponding to no rusting at 48 hours according to Japanese Industrial Standard (hereinafter usually abbreviated as "JIS") Z-2371. This performance, while satisfactory 15 years ago, is not unequivocally satisfactory at present. This patent application also describes the supplementary addition, at from 0.01 to 100 g/L as the compound, of an oxidizer such as nitric acid, hydrogen peroxide, or potassium permanganate, but does not provide a working example supporting the use of a potassium permanganate oxidizer.

Japanese Laid Open (Kokai or Unexamined) Patent Application Number Hei 8-144063 (144,063/1996) teaches a surface treatment method for the formation of conversion coatings on the surface of aluminum stock. This method uses an aqueous solution that contains potassium permanganate or potassium manganate or both in addition to a coating-forming accelerator such as a mineral acid ($HNO_3$, $H_2SO_4$, HF), an alkali (KOH, NaOH, $NH_4OH$), a neutral fluoride (KF, NaF), an acidic fluoride ($NH_4HF_2$, $NaHF_2$, $KHF_2$), or a fluorosilicate ($MnSiF_6$, $MgSiF_6$). However, the conversion coating formed by this treatment bath has not been found to have a corrosion resistance in long-term corrosion-resistance testing equal to or greater than that of chromate coatings.

Thus, as described above, the use of the aforementioned prior-art non-chromate-type surface treatment baths remains associated with problems with the corrosion resistance of the produced conversion coatings and pollution abatement of the effluent from the surface treatment bath. It is for these reasons that at present non-chromate-type surface treatment baths are little used on surface treatment lines where a particularly good corrosion resistance is required, for example, for aluminum fin stock for heat exchangers and aluminiferous metal coil and sheet stock.

In summary, then, there has yet to be established a bath, for treating aluminum and aluminum alloy surfaces, that does not contain hexavalent chromium, that requires little or no pollution abatement, and that has the ability to form highly corrosion-resistant, highly paint-adherent conversion coatings.

The surface treatment methods already mentioned above suffer from a number of practical and economic problems, such as (1) the use of high treatment bath concentrations, (2) the use of high treatment temperatures, and (3) the use of long treatment times, and improvements in each of these areas would be desirable.

Chromate treatments as typified by JIS H-8651 and U.S. Military Standard ("MIL") M-3171 are in use for treating magnesium and magnesium alloy surfaces (the word "magnesium" and all of its grammatical variations being understood hereinafter, unless the context indicates otherwise, to apply to alloys that contain at least, with increasing preference in the order given, 45, 60, 75, 85, 90, 95, or 99% by weight of magnesium). The conversion coatings generated by these chromate-type surface treatment baths exhibit an excellent corrosion resistance and an excellent adherence to paint films, but these treatment baths also contain highly toxic hexavalent chromium. The associated environmental problems have made it desirable to use treatment baths that are entirely free of hexavalent chromium.

The method disclosed in Japanese Laid Open (Kokai or Unexamined) Patent Application Number Hei 3-6994 (6,994/1991) is an invention typical of the chromium-free non-chromate-type surface treatment baths for magnesium and its alloys. This is a phosphate surface treatment method, and while it does not employ hexavalent chromium, it also does not have the ability to generate high-level properties. More specifically, this treatment method requires the execution of a silicate treatment after the phosphate treatment and the execution of a silicone treatment after the silicate treatment. The phosphate treatment coating by itself provides a low level of corrosion resistance and paint adherence when used as an underpaint treatment for magnesium and magnesium alloy surfaces. This treatment method also requires a multistage treatment process, uses high treatment temperatures, and requires long treatment times.

The known phosphate-based surface treatment methods include methods that employ treatment baths based on zinc phosphate, iron phosphate, calcium phosphate, or zirconium phosphate. However, these methods essentially cannot provide a corrosion resistance that is satisfactory at the level of practice.

A manganese phosphate treatment is disclosed in category 7 of JIS H-8651. However, this treatment bath contains chromium, requires high treatment temperatures of 80° C. to 90° C., and requires long treatment times of 30 to 60 minutes and thus is not acceptable from a practical standpoint.

Japanese Laid Open (Kokai or Unexamined) Patent Application Number Hei 8-35073 (35,073/1996) teaches a surface treatment method for the formation of conversion coatings on the surface of magnesium stock. This method uses an aqueous solution that contains permanganic acid or manganic acid or both in addition to a coating-forming accelerator such as a mineral acid ($HNO_3$, $H_2SO_4$, HF), an alkali (KOH, NaOH, $NH_4OH$), or a neutral fluoride ($MnSiF_6$, $MgSiF_6$). However, the conversion coating formed by this treatment bath has not been found to have a corrosion resistance in long-term corrosion-resistance testing equal to or greater than that of chromate coatings.

Thus, as described above, the use of the aforementioned prior-art non-chromate-type surface treatment baths for magnesium and its alloys remains associated with problems with the corrosion resistance of the produced conversion coatings and with requiring treatment conditions unsuitable from a practical standpoint. It is for these reasons that at present non-chromate-type surface treatment baths are little used on surface treatment lines where a particularly good corrosion resistance and paint adherence are required, for example, for magnesium alloy automotive materials, aerospace materials, and materials for electronic devices and instruments.

In summary, then, there has yet to be established a bath for treating magnesium and magnesium alloy surfaces that does not contain hexavalent chromium, that has excellent process characteristics, and that has the ability to form highly corrosion-resistant, highly paint-adherent conversion coatings.

PROBLEMS TO BE SOLVED BY THE INVENTION

The object of the present invention is to provide a surface treatment bath that can coat light metal and light metal alloy surfaces with a film that imparts an excellent corrosion resistance and excellent paint adherence to the treated surface.

SUMMARY OF THE INVENTION

It has been found that a highly corrosion-resistant, highly paint-adherent conversion coating can be formed on the surfaces of light metals and light metal alloys by the use of a surface treatment bath that has a pH of 1.0 to 7.0 and that contains specific amounts of permanganic acid or salt thereof and specific amounts of at least one compound selected from water-soluble titanium compounds and water-soluble zirconium compounds.

DETAILED DESCRIPTION OF THE INVENTION AND ITS PREFERRED EMBODIMENTS

A surface treatment bath according to the present invention has a pH from 1.0 to 7.0 and comprises, preferably consists essentially of, or more preferably consists of: 0.01 to 50 grams of permanganic acid and/or salt thereof per liter of the total treatment bath, this concentration unit being freely applied hereinafter to any constituent of the surface treatment bath and being hereinafter usually abbreviated as "g/L"; and 0.01 to 20 g/L of at least one compound selected from water-soluble titanium compounds and water-soluble zirconium compounds; and, optionally, one or more of a pH adjustment agent, a sequestering agent, a supplemental oxidizing agent, and a component of water-soluble manganese compounds other than permanganic acid and its salts. Such a bath is believed to form a manganese-containing composite coating comprising compounds of at least two of the heavy metal elements, i.e., manganese+titanium, or manganese +zirconium, or manganese+titanium+zirconium, and a conversion coating of this type preferably is formed in a process according to this invention, because this type of conversion coating exhibits the desired improved corrosion resistance. Furthermore, independently of other preferences, a composition according to this invention does not contain more than, with increasing preference in the order given, 1.0, 0.5, 0.2, 0.10, 0.070, 0.030, 0.010, 0.007, 0.003, 0.001, 0.0007, 0.0003, or 0.0001 percent by weight of chromium in any chemical form. This preferred exclusion, being motivated by avoidance of pollution and/or pollution abatement expense, applies only to chromium containing materials deliberately added to the compositions and not to any chromium containing materials that might be eluted into the compositions from their contact with substrates containing chromium as an alloying element.

A single selection or several selections from the group consisting of permanganic acid and its salts can be used to furnish permanganic acid or permanganate salt to the surface treatment bath according to the present invention. The particular species used is not crucial. The concentration of permanganic acid and/or salt(s) thereof in a surface treatment bath according to the invention preferably is at least, with increasing preference in the order given, 0.01, 0.05, 0.15, 0.25, 0.35, or 0.45 g/L, and unless the surface treatment bath also comprises a concentration of other manganese containing solutes that is at least as great as the concentration of permanganic acid and/or its salts more preferably is at least, with increasing preference in the order given, 0.55, 0.65, 0.75, 0.85, 0.95, 1.5, 2.0, 3.0, 4.0, or 4.5 g/L. Independently, the concentration of permanganic acid and/or its salt(s) preferably is not more than, with increasing preference in the order given, 50, 35, 20, 15, 10, or 6.0 g/L. While the use of lower concentrations of permanganic acid and/or salt(s) thereof still results in the formation of a conversion coating, such a coating may exhibit a poor resistance to corrosion and a poor paint adherence. At the other end of the range, good-quality conversion coatings are in fact obtained with concentrations above 50 g/L, but higher concentrations than this and even the moderately preferred concentrations lower than 50 g/L are almost always uneconomical, because insufficient increases in corrosion resistance or paint adhesion result to offset the higher costs of the treatment bath.

One or more selections from, for example, the sulfates, oxysulfates, acetates, ammonium salts, and fluorides of titanium and zirconium can be used to furnish the water-soluble titanium compound or water-soluble zirconium compound to the surface treatment bath according to the present invention. The particular species used is not crucial as long as it is a water-soluble compound. This component preferably is present in a treatment bath according to the invention at a concentration that is at least, with increasing preference in the order given, 0.01, 0.03, 0.05, 0.07, 0.075, 0.080, 0.085, 0.090, 0.095, or 0.100 g/L and independently preferably is not more than, with increasing preference in the order given, 20, 10, 5, 3, 2.0, 1.5, 1.2, 1.0, 0.80, 0.70, 0.60, or 0.55 g/L. Conversion coatings can be formed when this component is present at a concentration of less than 0.01 g/L, but such coatings usually have a poor corrosion resistance. At the other end of the range, good-quality conversion coatings are in fact obtained above 20 g/L, but quantities in excess of this value and the higher among even the moderately preferred concentrations are usually uneconomical because the performance improvement obtained with them is insufficient to offset the higher costs of a concentrated treatment bath.

The pH of the surface treatment bath according to the present invention must be from 1.0 to 7.0. When used to treat aluminum or aluminum alloy surfaces, the bath preferably has a pH that is at least, with increasing preference in the order given, 1.5, 2.0, 2.2, or 2.4 and independently preferably is not more than, with increasing preference in the order given, 6.0, 5.5, 5.0, or 4.6. When used to treat magnesium or magnesium alloy surfaces, the pH is strongly preferred to be at least 2.0. The metal substrate being treated normally will undergo excessive etching when the pH is below the given lower limit, so that an uneven appearance will be produced. A pH above the given upper limit can produce various problems, all of which are undesirable. These problems include the inability to obtain a highly corrosion-resistant conversion film and bath stability problems due to the facile production of precipitate from the metal ion present in the treatment bath. The pH of the surface treatment bath according to the present invention can be adjusted to a preferred value by using a suitable selection as known to those skilled in the art, from acids such as nitric acid, sulfuric acid, phosphoric acid, hydrofluoric acid, and fluorosilicic acid, and bases such as sodium hydroxide, sodium carbonate, potassium hydroxide, and ammonium hydroxide.

When the metal exposed to the treatment bath according to the present invention is an aluminum alloy containing copper, iron, or magnesium, the treatment bath may suffer from a substantial reduction in stability due to cations of the alloying component(s) that elute into the surface treatment bath. A sequestering agent may be added in such cases in order to chelate these metal alloy components. This sequestering agent can be, for example, an organic acid such as gluconic acid, heptogluconic acid, oxalic acid, tartaric acid, an organophosphonic acid, and ethylenediaminetetraacetic acid or an alkali metal salt thereof. These sequestering agents can also advantageously be used in the case of magnesium alloys containing, for example, aluminum or zinc.

A supplemental oxidizer other than permanganic acid and its salts may also be used in the present invention in order to accelerate formation of the conversion coating. This supplemental oxidizer can be exemplified by tungstic acid, molybdic acid, and their salts and by water-soluble organoperoxides such as tert-butyl hydroperoxide.

A conversion coating formed by the hereinabove described method preferably comprises manganese and at least one selection from titanium and zirconium. The Mn/(Ti+Zr) weight ratio in such a conversion coating is preferably from 0.05 to 100. When the substrate is aluminum or aluminum alloy, this weight ratio is more preferably, with increasing preference in the order given, from 0.1 to 20.0, from 0.2 to 5.0, or from 0.2 to 1.5. When the substrate is magnesium or a magnesium alloy, the aforementioned weight ratio is more preferably from 0.1 to 20 and most preferably is from 0.2 to 20. The corrosion resistance becomes increasingly poor as this weight ratio declines below the specified lower limit, while the long-term corrosion resistance becomes increasingly poor as this weight ratio increases above the specified upper limit.

Independently, the total coating weight for Mn, Ti, and Zr is preferably at least, with increasing preference in the order given, 5, 10, 20, or 30 milligrams of the metals per square meter of substrate surface treated, this unit of coating weight being hereinafter usually abbreviated as "$mg/m^2$", and independently preferably is not more than, with increasing preference in the order given, 500, 300, 270, or 240 mg/m$^2$. A coating weight below 5 mg/m$^2$ can cause an inadequate corrosion resistance and paint adherence. Good-quality conversion coatings are obtained at coating weights in excess of 500 mg/m$^2$, but coating weights in excess of this value and even coating weights among the higher moderately preferred values are usually uneconomical because any additional performance produced by the additional coating weight is insufficient to offset the higher costs of the treatment bath. In addition, the paint adherence becomes increasingly impaired as the coating weight increases above 500 mg/m$^2$, and coating weights above 500 mg/m$^2$ also result in substantial variations in the appearance.

The chemical characteristics of the metal in the coating, e.g., occurrence as the oxide or phosphate, etc., are not particularly critical for the manganese, titanium, and zirconium constituent components of the conversion coating according to the present invention.

The explanation will now turn to methods for treating light metals and light metal alloys using the surface treatment bath according to the present invention.

A surface treatment bath according to the present invention, in a preferred embodiment, is used as part of the following sequence of process operations:

(1) surface cleaning: degreasing (acidic, basic, or solvent degreasers can be used);
(2) water rinse;
(3) surface treatment using the surface treatment bath according to the present invention;
(4) water rinse;
(5) rinse with deionized water;
(6) drying.

A surface treatment bath according to the present invention is preferably brought into contact with the surface of the light metal or light metal alloy at a temperature that is at least, with increasing preference in the order given, 10, 15, or 20° C. and independently preferably is not more than 80, 75, or 70° C. Independently, the time of contact between the treatment bath according to this invention and the substrate being treated in a process according to the invention preferably is at least, with increasing preference in the order given, 1, 3, 5, 7, 9, 13, 16, 20, 25, or 28 seconds and independently preferably is not more than, with increasing preference in the order given, 300, 250, 220, 200, 180, 160, 140, or 120 seconds. The reactivity between the treatment bath and metal surface is usually inadequate at a contact temperature below 10° C., so that a good-quality conversion coating will not usually be formed at such temperatures. A conversion coating is still formed at a contact temperature above 80° C., but the increased energy costs associated with such temperatures make them uneconomical. Sufficient reaction to form a conversion coating that will exhibit a high level of corrosion resistance does not usually occur in a treatment time of less than 1 second. Times in excess of 300 seconds provide no additional improvement in the corrosion resistance or paint adherence of the resulting conversion coating.

Techniques such as immersion and spraying can be used to effect contact with the surface treatment bath according to the present invention.

The method used for the present invention preferably provides a conversion coating add-on on the light metal or light metal alloy surface of from 5 to 300 mg/m$^2$ as manganese and from 3 to 100 mg/m$^2$ as titanium and/or zirconium. The conversion coating will usually exhibit an inadequate corrosion resistance and paint adherence at a manganese add-on below 5 mg/m$^2$, while substantial irregularities in the external appearance of the conversion coating usually occur at values in excess of 300 mg/m$^2$. The conversion coating will often suffer from an inadequate corrosion resistance at a titanium or zirconium add-on below 3 mg/m$^2$. Highly corrosion-resistant conversion coatings are formed at a titanium or zirconium add-on above 100 mg/m$^2$, but such values are uneconomical since no additional performance is produced by the additional add-on.

The aluminum and aluminum alloys that may be subjected to surface treatment according to the present invention encompass pure aluminum and its alloys. Examples of the latter are alloys such as Al—Cu, Al—Mn, Al—Mg, and Al—Si. Similarly, the magnesium and magnesium alloys that may be subjected to surface treatment according to the present invention encompass materials of magnesium and magnesium alloy metals. The latter can be exemplified by Mg—Al—Zn, Mg—Zn, and Mg—Al—Zn—Mn.

The shape and dimensions of the light metal or light metal alloy used in the present invention are not critical, and, for example, the present invention encompasses both sheet stock and various formed products.

Working and comparative examples are provided below in order to more specifically describe the effects of the surface treatment bath according to the present invention. The materials used, together with indicia used to identify them in subsequent tables, are shown in Table 1 below.

Treatment Conditions for Substrate A

Substrate A was treated using the following processes in the sequence (1)→(2)→(3)→(4)→(5)→(6) to give the surface-treated sheet.

(1) Degreasing (60° C., 60 seconds, immersion)

A 3% aqueous solution of a commercial alkaline degreaser (FINECLEANER® 315 from Nihon Parkerizing Company, Limited) was used.

(2) Water rinse (ambient temperature, 30 seconds, spray)

(3) Conversion treatment (immersion)

Surface treatment was carried out using the composition and treatment conditions reported in Tables 1 and 2. The reagent weights reported in the

TABLE 1

| Material | Indicium and Description |
|---|---|
| Substrate | A: Al—Mn alloy sheet (JIS 3004), 150 millimeters × 70 millimeters by 0.2 millimeters thick. |
| | B: Die-cast sheet of the AZ91D magnesium alloy specified in JIS H2222, 150 millimeters × 70 millimeters by 0.2 millimeters thick. |
| Water-soluble manganese compound | a: manganese sulfate ($MnSO_4.H_2O$) |
| | b: potassium manganate ($K_2MnO_4$) |
| | c: potassium permanganate ($KMnO_4$) |
| Water-soluble titanium compound | A: 40% fluorotitanic acid ($H_2Tif_6$) |
| | B: 24% titanium sulfate {($Ti(SO_4)_2$)} |
| Water-soluble zirconium | (i): 20% fluorozirconic acid ($H_2ZrF_6$) |

TABLE 1-continued

| Material | Indicium and Description |
|---|---|
| compound | (ii): ammonium fluorozirconate $\{(NH_4)_2ZrF_6\}$ |
| pH adjuster | (I): 67.5% nitric acid ($HNO_3$) |
| | (II): 40% fluorosilicic acid ($H_2SiF_6$) |
| | (III): 25% aqueous ammonia ($NH_4OH$) |

"Conversion Treatment Bath Composition" columns in Table 2 are values that refer to the pure reagent.

The surface treatment conditions for Comparative Examples 5 to 7 are reported further below.

(4) Water rinse (ambient temperature, 30 seconds, spray)

(5) De-ionized water rinse (ambient temperature, 30 seconds, spray)

(6) Thermal drying (80° C., 3 minutes, forced convection oven)

Treatment Conditions for Substrate B

Substrate B was treated using the following processes in the sequence (1)→(2)→(3)→(4)→(5)→(6) to give the surface-treated sheet.

(1) Degreasing (60° C., 60 seconds, immersion)

The 3% aqueous solution of a commercial alkaline degreaser (FINECLEANER® 315 from Nihon Parkerizing Company, Limited) was used.

(2) Water rinse (ambient temperature, 30 seconds, spray)

(3) Surface treatment (immersion)

Surface treatment was carried out using the composition and treatment conditions reported in Tables 1 and 3. The reagent weights reported in the "Conversion Treatment Bath Composition" columns for Examples 6 to 10 and Comparative Examples 8 to 1 1 are values that refer to the pure reagent.

TABLE 2

| Working example or Comparison Example Number | Conversion Treatment Bath Composition in g/L | | | | | | |
|---|---|---|---|---|---|---|---|
| | Mn Compound(s) and Amount(s) | | Ti Compound(s) and Amount(s) | | Zr Compound(s) and Amount(s) | | pH Adjuster |
| WORKING EXAMPLES | | | | | | | |
| 1 | a | 1.0 | — | — | (i) | 0.3 | (III) |
| | b | 10.0 | | | | | |
| | c | 0.5 | | | | | |
| 2 | b | 3.0 | A | 0.5 | — | — | — |
| | c | 3.0 | | | | | |
| 3 | c | 5.0 | B | 0.8 | — | — | (I) |
| 4 | c | 5.0 | — | — | (i) | 0.1 | (II) |
| 5 | a | 1.0 | A | 0.1 | (ii) | 0.1 | (III) |
| | c | 1.0 | | | | | |
| COMPARATIVE EXAMPLES | | | | | | | |
| 1 | c | 10.0 | — | — | — | — | (I) |
| 2 | — | — | — | — | (i) | 0.3 | — |
| 3 | b | 10.0 | A | 0.008 | — | — | (I), (II) |
| 4 | a | 0.03 | A | 1.0 | — | — | (III) |
| 5 | — | — | — | — | — | — | — |
| 6 | — | — | — | — | — | — | — |
| 7 | — | — | — | — | — | — | — |

TABLE 2-continued

| | Treatment Conditions | | | Coating Weight in mg/m² of: | | | |
|---|---|---|---|---|---|---|---|
| | pH | Temperature, ° C. | Time, Seconds | Mn | Ti | Zr | Cr |
| WORKING EXAMPLES | | | | | | | |
| 1 | 4.5 | 60 | 60 | 5 | — | 30 | — |
| 2 | 2.6 | 35 | 180 | 110 | 80 | — | — |
| 3 | 2.4 | 50 | 30 | 28 | 12 | — | — |
| 4 | 3.5 | 60 | 60 | 68 | — | 8 | — |
| 5 | 3.5 | 70 | 10 | 50 | 12 | 45 | — |
| COMPARATIVE EXAMPLES | | | | | | | |
| 1 | 2.0 | 60 | 60 | 55 | — | — | — |
| 2 | 3.0 | 60 | 60 | — | — | 45 | — |
| 3 | 3.5 | 60 | 60 | 48 | 3 | — | — |
| 4 | 3.0 | 60 | 60 | 3 | 38 | — | — |
| 5 | 2.7 | 40 | 30 | — | — | 15 | — |
| 6 | 1.6 | 40 | 50 | — | — | — | 170 |
| 7 | 1.3 | 50 | 20 | — | — | — | 70 |

| | Weight Ratio, Mn/(Ti + Zr) | Total Coating Weight, Mn + Ti + Zr, mg/m² | Corrosion Resistance Salt Spray Test, 1,000 hours | Adherence, Number of Grid Squares remaining |
|---|---|---|---|---|
| WORKING EXAMPLES | | | | |
| 1 | 0.17 | 35 | +++ | 100 |
| 2 | 1.38 | 190 | +++ | 98 |
| 3 | 2.33 | 40 | ++ | 98 |
| 4 | 8.50 | 76 | ++ | 99 |
| 5 | 0.88 | 107 | +++ | 100 |
| COMPARATIVE EXAMPLES | | | | |
| 1 | | | + | 98 |
| 2 | | | × | 75 |
| 3 | 16.00 | 51 | + | 99 |
| 4 | 0.08 | 41 | × | 82 |
| 5 | | | × | 100 |
| 6 | | | +++ | 99 |
| 7 | | | ++ | 100 |

The surface treatment conditions for Comparative Examples 12 and 13 are reported further below.

(4) Water rinse (ambient temperature, 30 seconds, spray)

(5) De-ionized water rinse (ambient temperature, 30 seconds, spray)

(6) Thermal drying (80° C., 3 minutes, forced convection oven)

Comparative Example 1 is a comparative example that used a permanganate salt itself as the treatment bath component to form a manganese-containing coating.

Comparative Example 2 is a comparative example that used a Zr compound by itself as the treatment bath component to form a zirconium-containing coating.

TABLE 3

| Working Example or Comparison Example | Conversion Treatment Bath Composition in g/L | | | |
|---|---|---|---|---|
| | Mn Compound(s) | Ti Compound(s) | Zr Compound(s) and | pH |

TABLE 3-continued

| Number | and Amount(s) | and Amount(s) | | | Amount(s) | | Adjuster |
|---|---|---|---|---|---|---|---|
| | | WORKING EXAMPLES | | | | | |
| 6 | a | 1.0 | — | — | (i) | 0.3 | (III) |
| | b | 10.0 | | | | | |
| | c | 0.5 | | | | | |
| 7 | b | 3.0 | A | 0.5 | — | — | — |
| | c | 3.0 | | | | | |
| 8 | c | 5.0 | B | 0.8 | — | — | (III) |
| 9 | c | 5.0 | — | — | (i) | 0.1 | (II) |
| 10 | a | 1.0 | A | 0.1 | (ii) | 0.1 | (III) |
| | c | 1.0 | | | | | |
| | | COMPARATIVE EXAMPLES | | | | | |
| 8 | c | 10.0 | — | — | — | — | (I) |
| 9 | — | — | — | — | (i) | 0.3 | — |
| 10 | a | 0.05 | A | 0.008 | — | — | (III) |
| 11 | b | 10.0 | — | — | (i) | 0.008 | (III) |
| 12 | — | — | — | — | — | — | — |
| 13 | — | — | — | — | — | — | — |

| | Treatment Conditions | | | Coating Weight in mg/m$^2$ of: | | | |
|---|---|---|---|---|---|---|---|
| | pH | Temperature, ° C. | Time, Seconds | Mn | Ti | Zr | Cr |
| | | | WORKING EXAMPLES | | | | |
| 6 | 4.5 | 60 | 30 | 26 | — | 70 | — |
| 7 | 2.6 | 20 | 120 | 220 | 12 | — | — |
| 8 | 6.0 | 50 | 30 | 25 | 3 | — | — |
| 9 | 3.2 | 40 | 120 | 15 | — | 80 | — |
| 10 | 5.0 | 70 | 3 | 10 | 4 | 7 | — |
| | | | COMPARATIVE EXAMPLES | | | | |
| 8 | 4.0 | 50 | 120 | 40 | — | — | — |
| 9 | 3.0 | 40 | 60 | — | — | 33 | — |
| 10 | 3.0 | 70 | 20 | 1 | 135 | — | — |
| 11 | 7.5 | 40 | 120 | 29 | — | 0.2 | — |
| 12 | — | 30 | 60 | — | — | — | 20 |
| 13 | — | 95 | 1800 | — | — | — | 300 |

| | Weight Ratio, Mn/(Ti + Zr) | Total Coating Weight, Mn + Ti + Zr, mg/m$^2$ | Corrosion Resistance Salt Spray Test, 1,000 hours | Adherence, Number of Grid Squares remaining |
|---|---|---|---|---|
| | | WORKING EXAMPLES | | |
| 6 | 0.27 | 96 | +++ | 100 |
| 7 | 18.33 | 232 | +++ | 98 |
| 8 | 8.33 | 28 | ++ | 99 |
| 9 | 0.19 | 95 | +++ | 99 |
| 10 | 0.91 | 21 | ++ | 100 |
| | | COMPARATIVE EXAMPLES | | |
| 8 | | | + | 96 |
| 9 | | | × | 85 |
| 10 | 0.007 | 136 | + | 76 |
| 11 | 145.09 | 29.2 | + | 98 |
| 12 | | | ++ | 99 |
| 13 | | | +++ | 100 |

Comparative Example 3 produced a very low-Ti (Mn/Ti) coating, while Comparative Example 4 produced a very low-Mn (Mn/Ti) coating.

Comparative Example 5

This comparative example used a 7% aqueous solution of a commercial zirconium phosphate-based surface treatment agent (ALCHROME® 713 from Nihon Parkerizing Company, Limited) for conversion treatment. This bath was used to treat the Al—Mn alloy sheet specified above using the following treatment conditions: 40° C., 60 seconds, immersion. Treatment was followed by evaluation of the corrosion resistance and paint adherence.

Comparative Example 6

This comparative example used a 7% aqueous solution of a commercial chromic acid chromate conversion treatment agent (ALCHROME® 713 from Nihon Parkerizing Company, Limited) for surface treatment. This bath was used to treat the Al—Mn alloy sheet specified above using the following treatment conditions: 40° C., 60 seconds, immersion. Treatment was followed by evaluation of the corrosion resistance and paint adherence.

Comparative Example 7

This comparative example used a 3% aqueous solution of a commercial phosphoric acid chromate conversion treatment agent (mixed aqueous solution of 4% ALCHROME® K702SL and 0.3% ALCHROMEE® K702AC, both from Nihon Parkerizing Company, Limited) for the conversion treatment. This bath was used to treat the Al—Mn alloy sheet specified above using the following treatment conditions: 50° C., 20 seconds, spray. Treatment was followed by evaluation of the corrosion resistance and paint adherence.

Comparative Example 8

This comparative example used permanganate salt by itself as the treatment bath component to produce a manganese-containing coating.

Comparative Example 9

This comparative example used a Zr compound by itself as the treatment bath component to form a zirconium-containing coating.

Comparative Example 10

This produced a very low-Mn (Mn/Ti) film.

Comparative Example 11

This produced a very low-Zr (Mn/Zr) film.

Comparative Example 12

This comparative example used a 7% aqueous solution of a commercial chromic acid chromate conversion treatment agent (ALCHROMEQ® 713 from Nihon Parkerizing Company, Limited) for surface treatment. This bath was used to treat the magnesium alloy sheet specified above using the following treatment conditions: 30° C., 60 seconds, immersion. Treatment was followed by evaluation of the corrosion resistance and paint adherence.

Comparative Example 13

This comparative example used a treatment bath formulated according to MIL-M-3171C (TYPE III) for the surface treatment. The main component in this bath was sodium dichromate. This bath was used to treat the magnesium alloy sheet specified above using the following treatment conditions: 95° C., 30 minutes, immersion.

Evaluation Methods (1) Add-ons

The Mn, Ti, Zr, and Cr coating weights were measured using a fluorescent x-ray analyzer.

(2) Corrosion Resistance

The corrosion resistance was evaluated using the salt-spray test specified in JIS Z-2371. The status of corrosion development on the surface-treated sheet was visually evaluated after exposure to salt spray for 1,000 hours and was reported using the following scale:

+++: area of corrosion less than 10%

++: area of corrosion from 10% up to 50% (exclusive)

+: area of corrosion from 50% up to 90% (exclusive)

×: area of corrosion at least 90%

(3) Evaluation of Paint Adherence for Substrate A

This procedure was applied to the Al—Mn alloy sheet afforded by surface treatment under the conditions of Examples 1 to 5 and Comparative Examples 1 to 7. An epoxy-phenol paint for application to can lids was applied on the sheet surface to a paint film thickness of 5 $\mu$m followed by baking for 3 minutes at 220° C. A crosshatched grid of 100 squares (width=2 millimeters) was then executed in the center of the painted sheet using a cutter and the resulting specimen was immersed for 60 minutes in boiling de-ionized water. After the painted sheet had been air-dried, a cellophane tape peel test was carried out on the grid. The paint adherence was evaluated based on the number of unpeeled squares in the grid.

A larger number of unpeeled squares in this procedure is indicative of a better paint adherence, and a score of 98 or more unpeeled squares corresponds to a satisfactory performance at the level of practice.

The results of this evaluation are reported in Table 2.

(4) Evaluation of Paint Adherence for Substrate B

This procedure was applied to the magnesium alloy sheet afforded by surface treatment under the conditions of Examples 6 to 10 and Comparative Examples 8 to 13. An epoxy resin paint was applied on the sheet surface to a dried paint film thickness of 10 $\mu$m followed by baking for 10 minutes at 200° C. A crosshatched grid of 100 squares (width=2 millimeters) was then executed in the center of the painted sheet using a cutter and the resulting specimen was immersed for 60 minutes in boiling de-ionized water. After the painted sheet had been air-dried, a cellophane tape peel test was carried out on the grid. The paint adherence was evaluated based on the number of unpeeled squares in the grid.

A larger number of unpeeled squares in this procedure is indicative of a better paint adherence, and a score of 98 or more unpeeled squares corresponds to a satisfactory performance at the level of practice.

The results of this evaluation are reported in Table 3.

Tables 2 and 3 demonstrate that the conversion coatings afforded by the treatment bath according to the present invention exhibit the same corrosion resistance as commercial chromic acid chromate and phosphoric acid chromate treatments. These tables also confirm that highly corrosion-resistant coatings can be realized by the formation of composite coatings in which suitable amounts of Mn and Ti/Zr are both present.

As the preceding explanation makes clear, a hexavalent chromium-free, highly corrosion-resistant, and highly paint-adherent conversion coating is produced by the application of the surface treatment bath according to the present invention to light metals and light metal alloys.

This performance makes the surface treatment bath according to the present invention very useful at a practical level for application to light metals and light metal alloys.

The materials used for the casings and shells of, for example, computers and portable phones, have recently shifted from plastics to magnesium alloys based on considerations of recyclability, thermal radiation, and relative strength per unit weight. At the same time, the electromagnetic radiation generated by electronic devices, known as noise, can cause other computer devices to malfunction with the production of numerous problems. Within the sphere of electronic devices that employ magnesium alloy materials, this noise problem has created desire for the appearance of a surface treatment method that provides an excellent electromagnetic shielding performance in addition to an excellent corrosion resistance and excellent paint adherence. The coating formed by the surface treatment bath according to the present invention does not contain toxic chromium, exhibits excellent corrosion resistance and excellent paint adherence, and also has a low surface resistance and thereby can also provide an excellent electromagnetic shielding performance.

What is claimed is:

1. An aqueous liquid composition for treating the surfaces of light metals and light metal alloys, said liquid composition having a pH value within a range from 1.0 to 7.0 and consisting essentially of water and the following components:

(A) from 0.01 to 50 g/L of a component selected from the group consisting of permanganic acid, water soluble salts thereof, and mixtures of any two or more of permanganic acid and any of its water soluble salts;

(B) from 0.01 to 20 g/L of a component selected from the group consisting of water soluble compounds of titanium, water soluble compounds of zirconium, and mixtures of any two or more of said water soluble compounds of titanium and zirconium; and, optionally, one or more components selected from (i) one or more water soluble manganese compounds other than permanganic acid or its salts, (ii) one or more pH adjustment agents other than phosphoric acid, (iii) one or more sequestering agents, or (iv) one or more supplemental oxidizing agents, wherein said aqueous liquid composition is free from phosphate ions.

2. A composition according to claim 1, wherein:

the pH is from 1.0 to 6.0;

the concentration of component (A) is from 0.5 to 15 g/L; and the concentration of component (B) is from 0.090 to 3 g/L.

3. A composition according to claim 2, wherein the pH value is from 2.4 to 6.0 and the composition contains not more than 0.01 percent of chromium in any chemical form.

4. A process for forming a corrosion reducing coating on a substrate selected from the group consisting of aluminum, magnesium, and alloys containing at least 45% by weight of aluminum, magnesium, or each of aluminum and magnesium, said process comprising an operation of contacting said substrate with a composition having a pH from 2.4 to 6.0 and consisting essentially of water and the following components:

(A) from 0.5 to 15 g/L of a component selected from the group consisting of permanganic acid, water soluble salts thereof, and mixtures of any two or more of permanganic acid and any of its water soluble salts;

(B) from 0.090 to 3 g/L of a component selected from the group consisting of water soluble compounds of titanium, water soluble compounds of zirconium, and mixtures of any two or more of said water soluble compounds of titanium and zirconium; and, optionally, one or more components selected from (i) one or more water soluble manganese compounds other than permanganic acid or its salts, (ii) one or more pH adjustment agents other than phosphoric acid, (iii) one or more sequestering agents, or (iv) one or more supplemental oxidizing agents, wherein said aqueous liquid composition is free from phosphate ions and contains not more than 0.01 percent of chromium in any chemical form, said contacting being for a time interval of at least 3 seconds, during which said composition is maintained within a temperature range from 20 to 80° C., said process forming on said substrate a coating that contains manganese and at least one of zirconium and titanium.

5. A process according to claim 4, wherein:

said corrosion reducing coating comprises:

from 5 to 300 mg/m$^2$ of manganese, from 3 to 100 mg/m$^2$ of a total of zirconium and titanium, and from 5 to 500 mg/m$^2$ of a total of manganese, zirconium, and titanium; and the ratio by weight of manganese to the sum of titanium and zirconium in said corrosion reducing coating is from 0.05 to 100.

6. A process according to claim 5, wherein:

said substrate contains at least 60 percent by weight of aluminum;

said corrosion reducing coating comprises a total from 30 to 240 mg/m$^2$ of a total of manganese, zirconium, and titanium; and the ratio by weight of manganese to the sum of titanium and zirconium in said corrosion reducing coating is from 0.2 to 5.

7. A process according to claim 5, wherein:

said substrate contains at least 60 percent by weight of magnesium;

said corrosion reducing coating comprises a total from 30 to 240 mg/m$^2$ of a total of manganese, zirconium, and titanium; and the ratio by weight of manganese to the sum of titanium and zirconium in said corrosion reducing coating is from 0.2 to 20.

8. A process for forming a corrosion reducing coating on a substrate selected from the group consisting of aluminum, magnesium, and alloys containing at least 45% by weight of aluminum, magnesium, or each of aluminum and magnesium, said process comprising an operation of contacting said substrate with a composition according to claim 2 for a time interval of at least 1 second, said composition being maintained during said contacting within a temperature range from 10 to 80° C., said process forming on said substrate a coating that contains manganese and at least one of zirconium and titanium.

9. A process according to claim 8, wherein:

said corrosion reducing coating comprises:

from 5 to 300 mg/m$^2$ of manganese, from 3 to 100 g/m$^2$ of a total of zirconium and titanium, and from 5 to 500 mg/m$^2$ of a total of manganese, zirconium, and titanium; and the ratio by weight of manganese to the sum of titanium and zirconium in said corrosion reducing coating is from 0.05 to 100.

10. A process according to claim 9, wherein:

said substrate contains at least 60 percent by weight of aluminum;

said corrosion reducing coating comprises a total from 30 to 240 mg/m$^2$ of a total of manganese, zirconium, and titanium; and the ratio by weight of manganese to the sum of titanium and zirconium in said corrosion reducing coating is from 0.2 to 5.

11. A process according to claim 8, wherein:

said substrate contains at least 60 percent by weight of magnesium;

said corrosion reducing coating comprises a total from 30 to 240 mg/m$^2$ of a total of manganese, zirconium, and titanium; and the ratio by weight of manganese to the sum of titanium and zirconium in said corrosion reducing coating is from 0.2 to 20.

12. A process for forming a corrosion reducing coating on a substrate selected from the group consisting of aluminum, magnesium, and alloys containing at least 45% by weight of aluminum, magnesium, or each of aluminum and magnesium, said process comprising an operation of contacting said substrate with a composition according to claim 1 for a time interval of at least 1 second, said composition being maintained during said contacting within a temperature range from 10 to 80° C., said process forming on said substrate a coating that contains manganese and at least one of zirconium and titanium.

13. A process according to claim 12, wherein:

said corrosion reducing coating comprises:

from 5 to 300 mg/m$^2$ of manganese, from 3 to 100 g/m$^2$ of a total of zirconium and titanium, and from 5 to 500 mg/m$^2$ of a total of manganese, zirconium, and titanium; and the ratio by weight of manganese to the sum of titanium and zirconium in said corrosion reducing coating is from 0.05 to 100.

14. A process according to claim 13, wherein:

said substrate contains at least 60 percent by weight of aluminum;

said corrosion reducing coating comprises a total from 30 to 240 mg/m$^2$ of a total of manganese, zirconium, and titanium; and the ratio by weight of manganese to the sum of titanium and zirconium in said corrosion reducing coating is from 0.2 to 5.

15. A process according to claim 13, wherein:

said substrate contains at least 60 percent by weight of magnesium;

said corrosion reducing coating comprises a total from 30 to 240 mg/m$^2$ of a total of manganese, zirconium, and titanium; and the ratio by weight of manganese to the sum of titanium and zirconium in said corrosion reducing coating is from 0.2 to 20.

16. An aqueous liquid composition for treating the surfaces of light metals and light metal alloys, said liquid composition having a pH value within a range from 1.0 to 6.0 and comprising water and the following components:

(A) from 0.01 to 50 g/L of a component selected from the group consisting of permanganic acid, water soluble salts thereof, and mixtures of any two or more of permanganic acid and any of its water soluble salts; and (B) from 0.01 to 20 g/L of a component selected from the group consisting of water soluble compounds of titanium, water soluble compounds of zirconium, and mixtures of any two or more said water soluble compounds of titanium and zirconium, wherein at least 0.01 g/l of this component consists of water soluble compounds of zirconium, and wherein said aqueous liquid composition is free from phosphate ions and contains not more than 0.01 percent of chromium in any chemical form.

17. A composition according to claim 16, wherein:

the pH is from 2.4 to 6.0;

the concentration of component (A) is from 0.5 to 15 g/L;

the concentration of component (B) is from 0.090 to 3 g/L.

18. A composition according to claim 16, wherein the concentration of water soluble compounds of zirconium of component (B) is at least 0.01 g/L.

* * * * *

UNITED STATES PATENT AND TRADEMARK OFFICE

CERTIFICATE OF CORRECTION

PATENT NO. : 6,485,580 B1
DATED : November 26, 2002
INVENTOR(S) : Nakada et al.

It is certified that error appears in the above-identified patent and that said Letters Patent is hereby corrected as shown below:

Column 18,
Line 1, after “more”, insert therefor -- of --.
Line 16, delete “0.01”, and insert therefor -- 0.1 --.

Signed and Sealed this

Third Day of February, 2004

JON W. DUDAS
*Acting Director of the United States Patent and Trademark Office*